United States Patent [19]

Eysn et al.

[11] Patent Number: 4,588,169

[45] Date of Patent: May 13, 1986

[54] ARRANGEMENT TO BE USED WITH A TILTABLE METALLURGICAL VESSEL

[75] Inventors: Manfred Eysn, Puchenau; Viktor Ducai, Linz; Kurt Hohmann, Ybbs, all of Austria

[73] Assignee: Voest-Alpine Aktiengesellschaft, Linz, Austria

[21] Appl. No.: 650,901

[22] Filed: Sep. 14, 1984

[30] Foreign Application Priority Data

Sep. 28, 1983 [AT] Austria ..... 3437/83

[51] Int. Cl.[4] ..... C21B 7/08

[52] U.S. Cl. ..... 266/165; 266/281

[58] Field of Search ..... 266/165, 142, 281, 245, 266/143, 287

[56] References Cited

U.S. PATENT DOCUMENTS

| | | | |
|---|---|---|---|
| 3,141,916 | 7/1964 | McFeaters et al. | 266/165 |
| 3,866,382 | 2/1975 | Van Tassel | 266/281 |
| 4,039,174 | 8/1977 | Poff et al. | 266/281 |
| 4,061,319 | 12/1977 | Tanaka et al. | 266/281 |
| 4,077,616 | 3/1978 | Smejkal et al. | 266/281 |
| 4,130,924 | 12/1978 | Madill | 266/281 |

FOREIGN PATENT DOCUMENTS

| | | | |
|---|---|---|---|
| 311399 | 11/1969 | Austria . | |
| 1154131 | 9/1963 | Fed. Rep. of Germany | 266/281 |
| 2903361 | 7/1980 | Fed. Rep. of Germany . | |
| 2314331 | 10/1976 | France . | |
| 0062068 | 11/1969 | Luxembourg . | |

OTHER PUBLICATIONS

Japanese Patent Abstract No. 57-203714(A), 12/14/82.

*Primary Examiner*—L. Dewayne Rutledge
*Assistant Examiner*—S. Kastler
*Attorney, Agent, or Firm*—Brumbaugh, Graves, Donohue & Raymond

[57] ABSTRACT

An arrangement for the installation or removal of a mouth ring comprised of mouth-ring segments and provided on the mouth of a tiltable metallurgical vessel. In order to simply and quickly install and remove a mouth ring, even if the converter is within a closed chamber and difficult to accede, a car is provided which is displaceable below the metallurgical vessel when tilted in the upside-down position. The car is provided with a platform that can be lifted and lowered by a lifting device and includes at least one support for a mouth-ring segment, which is displaceable and pivotable in the plane of the platform.

6 Claims, 6 Drawing Figures

ARRANGEMENT TO BE USED WITH A TILTABLE METALLURGICAL VESSEL

BACKGROUND OF THE INVENTION

This invention relates to an arrangement for the installation or removal of a mouth ring comprised of mouth-ring segments provided on the mouth of a tiltable metallurgical vessel, in particular a steel works converter.

The mouth ring of a steel works converter constitutes a wear part that must be renewed after or during a converter campaign. In order to allow the converter to deform, the mouth ring is comprised of segments, each of the segments being fastened to the converter by special fastening means, i.e. to a supporting flange of the converter shell. The mouth-ring segments that are locat3ed on the tapping and charging sides of the converter require replacement more frequently than the remaining mouth-ring segments.

It is known to exchange these mouth-ring segments by means of separate hoists provided at the converter stand, after lateral removal of the exhaust hood. Recently, converters have been surrounded by closed chambers arranged within the steel works building to protect the personnel of a steel works. Such closed chambers impede access to the converter, making it particularly difficult to renew the mouth ring. In order to exchange the mouth ring, it is necessary to remove, and subsequently re-install, parts of the chamber.

SUMMARY OF THE INVENTION

The invention aims at avoiding these disadvantages and difficulties and has as its object to provide an arrangement which enables a simple and quick installation and removal of a mouth ring, even if the converter is surrounded by a closed chamber and is difficult to reach. In particular, the exchange of a mouth ring is to be feasible without having to remove and install parts of the chamber.

This object of the invention is achieved by means of an arrangement comprising a car, which is displaceable below the metallurgical vessel tilted in the upside-down position and which is provided with a platform that is liftable and lowerable by a lifting means and includes at least one support for a mouth-ring segment, the support being displaceable and pivotable in the plane of the platform. The space below the converter is accessible with converters installed in chambers, because space is required for metallurgical vehicles, such as ladle transporting cars, slag transporting cars, crucible exchanging cars, etc. The invention utilizes effectively this free space below the converter for the installation and removal of the mouth ring, by tilting the converter in the upside-down position.

Preferably, the platform is rotatable about a vertical axis relative to the car.

A particular advantage of the invention is that no separate car is required to exchange the mouth ring. Any metallurgical vehicle available in a steel works may be used. A steel extraction car, on which a converter bottom lifting means, such as the device disclosed in Austrian Pat. No. 311,399, is placed, is suited for this purpose. Such lifting means also is available in a steel works when using converters with removable bottoms. Liftable and lowerable lining means, e.g., according to Austrian Pat. No. 338,849, are also suited for the exchange of mouth rings.

When using such a steel extraction car with converter bottom lifting means, the platform suitably is formed by a frame loosely resting on counter supporting surfaces of the lifting means via several supporting means.

According to a preferred embodiment, the support for a mouth-ring segment is formed by a sled loosely resting on the platform and displaceable relative to the platform by at least two adjustment means arranged at an angle relative to each other.

Preferably, the adjustment means are designed as adjustment spindles arranged parallel to the plane of the platform and mounted on the sled so as to be pivotable about a vertical axis, the counter bearing of each adjustment spindle being transplaceably supported on the platform.

A particularly simple construction is characterized in that the platform supporting the counter bearing comprises a girder with a T-shaped section and the counter bearing comprises a T-shaped recess, the smallest distance of opposite walls of the recess being larger than the width of the flange of the girder having a T-shaped section, and, the counter bearing is penetrated by the adjustment spindle with play provided in the axial direction of the adjustment spindle.

BRIEF DESCRIPTION OF THE DRAWINGS

The invention will now be explained in more detail by way of two embodiments illustrated in the accompanying drawings, wherein.

DETAILED DESCRIPTION OF EXEMPLARY EMBODIMENTS

Figure 1:
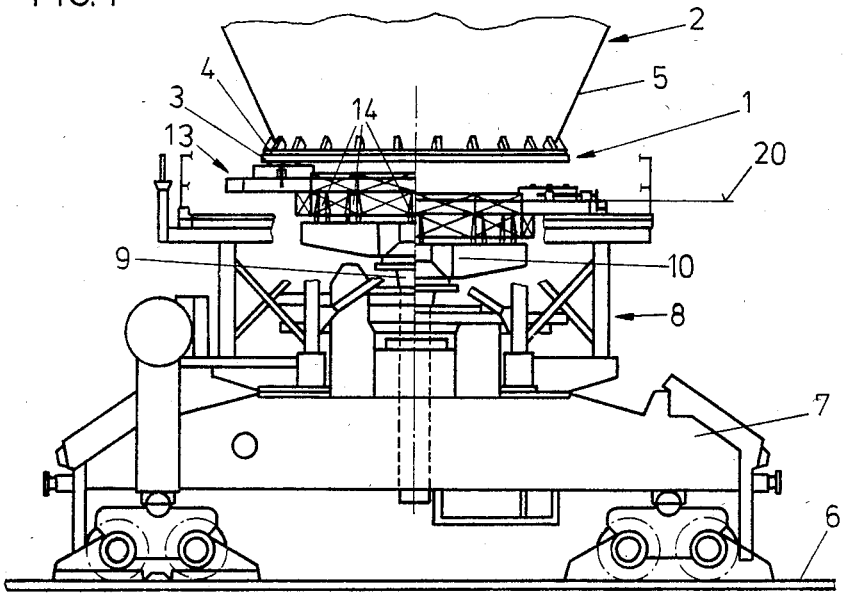
FIG. 1 is a side view of the arrangement according to the invention.

The mouth 1 of a converter 2 tilted in the upside-down position is illustrated in FIG. 1. A mouth ring 3 comprised of eight segments 3', 3'', . . . is fastened to a mouth flange 4 of the converter shell 5. Each of the mouth-ring segments 3', 3'', . . . is made of plate having a thickness of about 100 mm and weighing about 1,000 kg. Positioned below the converter 1, a steel extraction car 7, displaceable on rails 6, supports a converter bottom lifting means 8. The converter bottom lifting means 8 comprises a hydraulically actuatable central piston 9 carrying a four-point star 10 on its upper end to accommodate a converter bottom.

Figure 3:
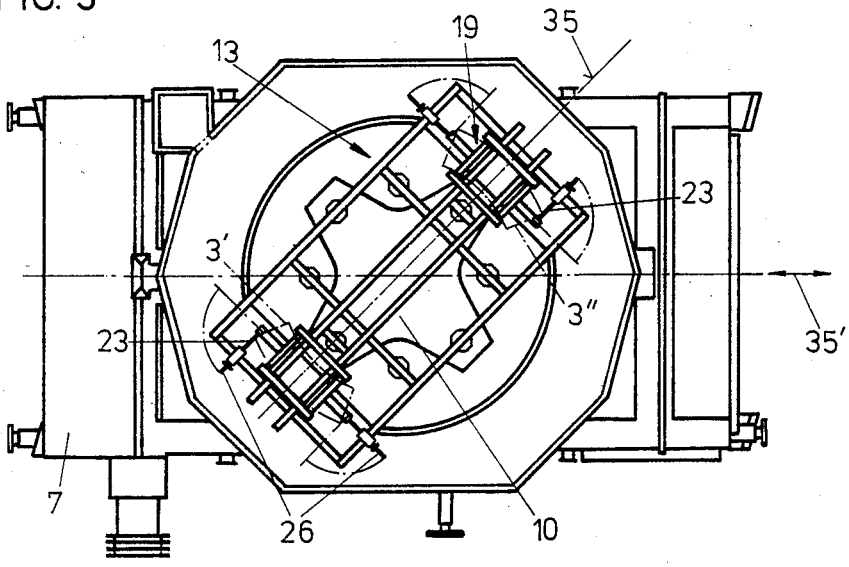
FIG. 3 is a view of a turned position of the platform of the arrangement in an illustration analogous to FIG. 2.

In the present case, a rectangular frame 13 (FIG. 2) comprised of longitudinal and transverse girders 11 and 12 with a double-T cross-section is placed on this star. Eight supporting means 14 extending vertically downwards and designed as standards 14 are welded to the frame, four of which rest loosely on the ends of the points 10' of the star 10. Guides (not illustrated) secure the standards 14, and thus the frame 13, against lateral displacement. The frame 13 forming a platform is placed onto the star 10 in an appropriate position by a crane. On each of the narrow sides 15, 16 of the rectangular frame 13 is a sled 19, which is also formed by longitudinal and transverse girders 17, 18 and which loosely rests on the central longitudinal girders 11 of the frame 13. Each sled 19 constitutes the support for a mouth-ring segment 3', 3'', . . . , which is illustrated in FIGS. 2 and 3 in dot-and-dash lines.

Since the mouth 1 of a converter 2 during a converter campaign, deforms more or less intensively, i.e., deviates from the ideal circular shape, each of the sleds 19 is mounted on the frame 13 so as to be displaceable and pivotable in the plane 20 of the frame or platform. The displacement or pivoting of the sled 19 is effected by means of two adjustment spindles 23 hinged to lateral arms 21 of the sled 19 and pivotable about a vertical axis 22, with counter bearings 24 of the adjustment spindles 23 positioned on the longitudinal or transverse girders 11, 12 of the frame 13.

Figure 4:
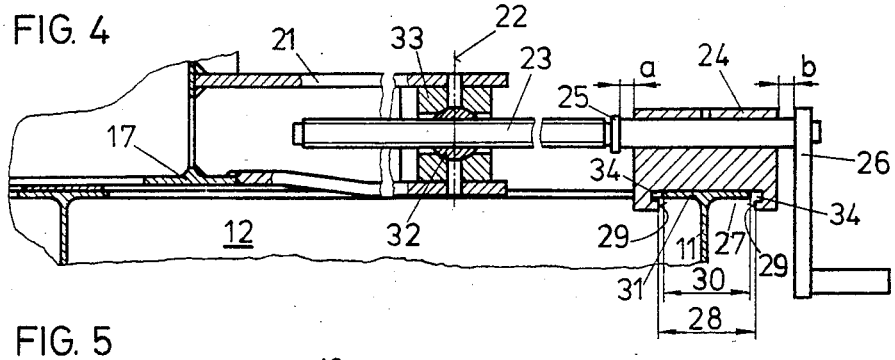
FIG. 4 illustrates a section along line IV—IV of FIG. 2 on an enlarged scale.

As is apparent from FIG. 4, the counter bearing 24 is displaceable, by an amount a+b in the axial direction of the adjustment spindle 23, between a collar 25 of the adjustment spindles 23 and the crank handle 26 attached to the end of the adjustment spindle. The counter bearing 24 has a T-shaped groove 27, the distance 28 of the vertical outer groove surface 29 being larger than the width 30 of the flange 31 of the double-T girders 11, 12 forming the frame. By turning the spindle, it is possible to move the counter bearing 24 into the central position illustrated in FIG. 4 by means of the crank handle 26, whereupon the counter bearing 24 can be manually lifted and, after pivoting of the adjustment spindles 23 about the vertical axis 22, can be deposited on any other place of the frame 13. In order to ensure lifting and lowering of the counter bearing 24, the spindle nut 32 is cylindrically designed and mounted in a bearing part 33 on the arm 21. By turning the adjustment spindle 23, either the crank handle 26 or the collar 25 will abut on the counter bearing 24, whereby the counter bearing 24 is displaced so much that the flange 31 of the double-T girders 11 and 12 forming the frame 13 engages in one of the re-entrant groove parts 34. By further turning of the adjustment spindle the sled 19 is displaced relative to the frame 13.

Figure 2:
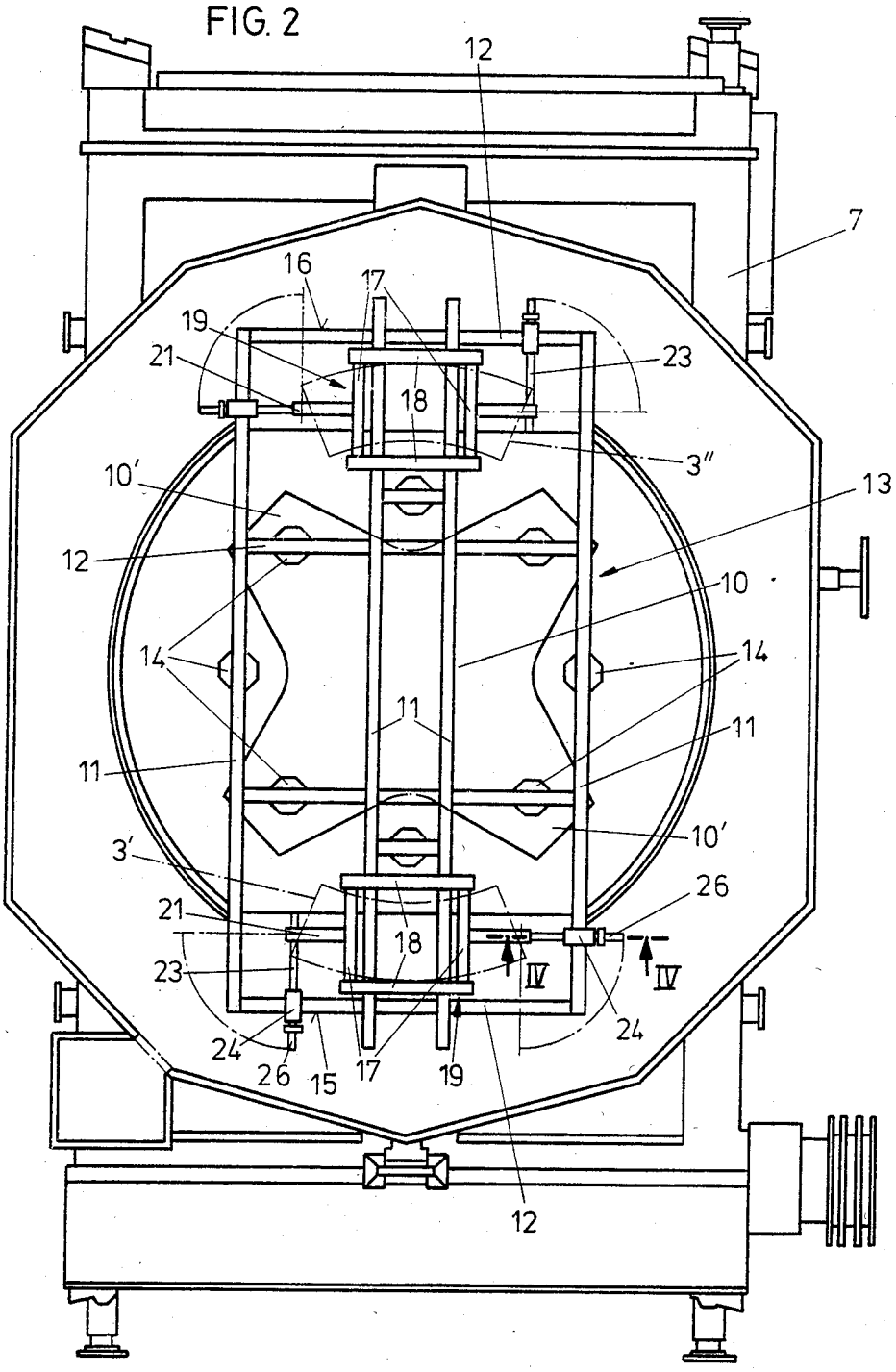
FIG. 2 is a top view of the arrangement according to the invention.

As is apparent from FIG. 2, it is possible to let the sled 19 assume any desired position relative to the frame 13. However, stops (not illustrated) are provided to delimit the movement of the sled relative to the frame.

The arrangement functions in the following manner:

If a mouth-ring segment 3', 3'', . . . of a converter 2 is to be exchanged, the car 7 with the bottom lifting means 8 and the frame 13 placed on it is first positioned below the converter 2 tilted in the upside-down position so that the sled 19 will be approximately below the mouth-ring segment 3', 3'', . . . to be exchanged.

Subsequently, the frame 13 is lifted by the hydraulically liftable piston 9 until the sled 19 comes to lie closely below the segment 3', 3'', . . . , whereupon the sled 19 is positioned by means of the adjustment spindles 23 relative to the mouth-ring segment 3', 3'', . . . to be exchanged, so that the mouth-ring segment 3', 3'', . . . will be located approximately symmetrically above the sled 19. Then, the frame 13 is lifted further until the mouth ring 3 nearly contacts the sled 19. Thereafter, spacers are inserted between the mouth ring 3 and the sled 19. The fastening elements, e.g., screw nuts, of the mouth-ring segments 3', 3'', . . . to be removed are undone. Subsequently, the frame 13 is lowered and the car 7 moves laterally to a position beside the converter 2. By a lifting means, such as a hall crane, the mouth-ring segment 3', 3'', . . . is lifted off the sled 19 and an intact mouth-ring segment 3', 3'', . . . is placed on the sled 19, also in the symmetrical position relative to the sled. (Stops (not illustrated) mounted on the sled serve to adjust the mouth-ring segments 3', 3'', . . . ). Thereupon, the car 7 again moves to a position below the converter 2 , whereupon the frame 13 is lifted so much that the fastening means penetrate the intact mouth-ring segment 3', 3'', . . . , whereupon the mouth-ring segment 3', 3'', . . . is lifted off the sled 19 via the screw nuts by tightening the same.

The particular advantage of an exchange of this kind is that the sled need be adjusted just once, i.e., when removing the mouth-ring segments to be exchanged. If a mouth-ring segment neighboring the first mouth-ring segment is to be exchanged, the frame is positioned on the star 10 so as to be displaced by about 45° by means of the hall crane upon lateral displacement of the car 7 to a position beside the converter, after previous lowering of the frame 13, i.e., the longitudinal axis 35 of the rectangular platform will then form an angle of 45° with the moving direction 35' of the car 7, as is illustrated in FIG. 3.

By the arrangement illustrated in FIGS. 1 and 3, the simultaneous installation and removal of two mouth-ring segments 3', 3'', . . . is possible. The embodiment of the arrangement illustrated in FIGS. 5 and 6 comprises a cross-shaped frame 36 including four sleds 19, whereby it is possible to simultaneously remove and install four mouth-ring segments 3' to 3''''.

Figure 5:
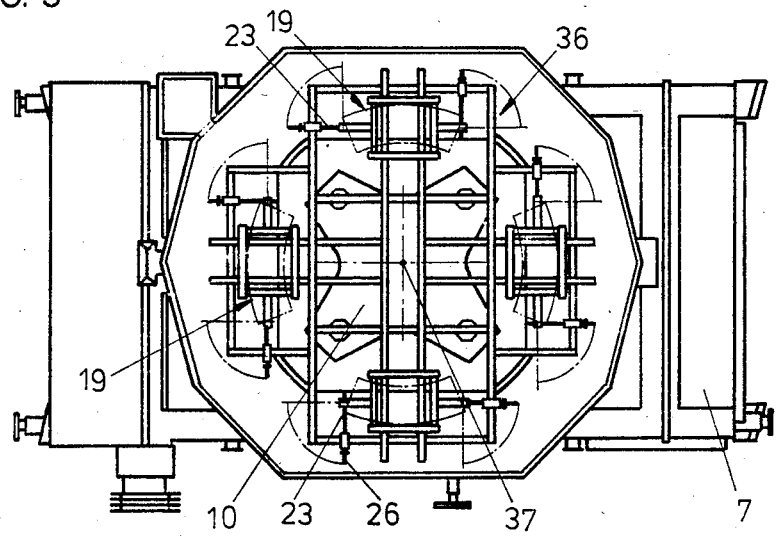
FIGS. 5 and 6 show a second embodiment of the invention in an illustration analogous to FIGS. 2 and 3.
Figure 6:
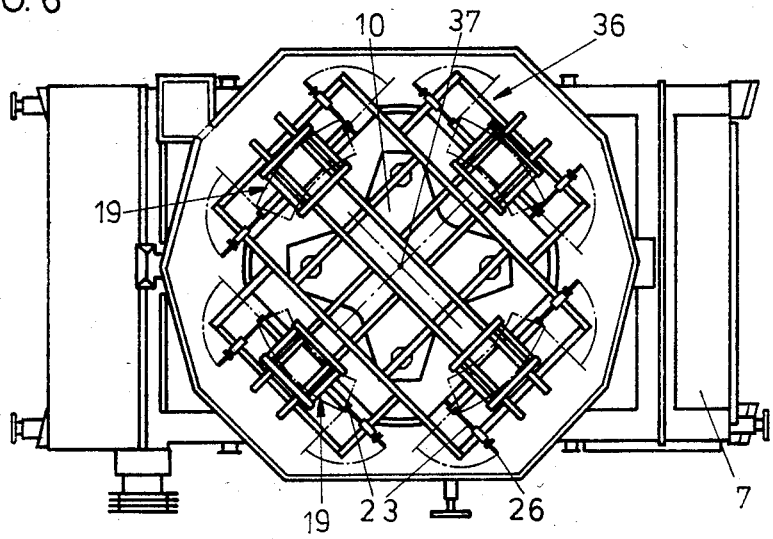

With the embodiment illustrated in FIGS. 5 and 6, the star 10 of the bottom lifting means 8 is not only liftable and lowerable, but also rotatable about its vertical axis 37, so that, by turning the star 10, the frame 36 is rotatable from the position illustrated in FIG. 5 into the position illustrated in FIG. 6. In this position, the remaining four of the total of eight mouth-ring segments 3', 3'', . . . can be installed or removed.

The invention is not limited to the embodiments illustrated in the drawings. If, for instance, the mouth ring is comprised of only four mouth-ring segments, the entire mouth ring, together with the frame 36, on which four sleds 19 are mounted, as is shown in FIG. 5, can be installed or removed in one operation step without a rotation of the frame 36 about its vertical axis 37.

What we claim is:

1. In an arrangement for installing and removing the mouth ring of a tiltable metallurgical vessel, such as a steel works converter, in which the mouth ring is comprised of a plurality of mouth ring segments releasably secured to the vessel around its mouth, and wherein said vessel is tilted in its upside-down position with the mouth ring facing downward during installation and removal of the mouth ring segments, the improvement which comprises, a car displaceable into position below the mouth of said vessel with said vessel in the upside-down position, a platform provided on said car, at least one support means on said platform, said support means having an upper side for holding a mouth ring segment, means for displacing and pivoting said at least one support means to align said support means with the position of a selected mouth ring segment on said vessel, and means for lifting and lowering said platform, with said car below the mouth of said vessel, to position said at least one support means at a level at which said upper side would be nearly in contact with the lower surface of a mouth ring segment on said vessel, thereby enabling a mouth ring segment carried by said support means to be secured to said vessel or said support means to receive a mouth ring segment released from said vessel.

2. An arrangement as set forth in claim 1, wherein said platform is rotatable about a vertical axis relative to said car.

3. An arrangement as set forth in claim 1, wherein said platform is comprised of a frame including a plurality of supporting means and said lifting means includes counter supporting surfaces, said frame loosely resting on said counter supporting surfaces by said plurality of supporting means.

4. An arrangement as set forth in claim 1, wherein said mouth-ring-segment support is formed by a sled loosely resting on said platform, and said means for displacing said mouth-ring-segment support comprises at least two adjustment means provided at an angle to each other for displacing said sled relative to said platform.

5. In an arrangement for installing and removing the mouth ring of a tiltable metallurgical vessel, such as a steel works converter, having a mouth provided with a mouth ring comprised of a plurality of mouth ring segments, wherein said vessel is tilted in its upside-down position during installation and removal, the improvement which comprises a car displaceable below said tiltable metallurgical vessel with said vessel in its upside-down position, a platform provided on said car, a lifting means for lifting and lowering said platform, at least one support for holding a mouth ring segment provided on said platform, said mouth ring segment support being formed by a sled loosely resting on said platform, and means including at least two adjustment means for displacing and pivoting said at least one mouth ring segment support in the plane of said platform, said at least two adjustment means being disposed at an angle to each other, each of said adjustment means including a spindle disposed parallel to the plane of said platform and mounted on said sled so as to be pivotable about vertical and horizontal axes, each of said adjustment spindles having a counter bearing transplaceably supported on said platform.

6. An arrangement as set forth in claim 5, further comprising a girder having a T-shaped section and provided on said platform for supporting said counter bearing, a T-shaped recess defined by walls being provided in said counter bearing, and a flange provided on said girder, the smallest distance of opposite walls of said recess being larger than the width of said flange and said counter bearing being penetrated by said adjustment spindle with a play provided in the axial direction of said adjustment spindle.

* * * * *